US005775690A

United States Patent [19]

Quesnel et al.

[11] Patent Number: 5,775,690

[45] Date of Patent: Jul. 7, 1998

[54] TWO STEP OPTIMIZED STALLED ROLL REGISTRATION AND DESKEW

[75] Inventors: Lisbeth S. Quesnel, Pittsford; David M. Attridge, Rochester, both of N.Y.

[73] Assignee: Xerox Corporation, Stamford, Conn.

[21] Appl. No.: 626,062

[22] Filed: Apr. 1, 1996

[51] Int. Cl.[6] ..... B65H 9/04

[52] U.S. Cl. ..... 271/242; 271/265.01

[58] Field of Search ..... 271/242, 265.01, 271/266, 258.01

[56] References Cited

U.S. PATENT DOCUMENTS

| | | | |
|---|---|---|---|
| 4,523,832 | 6/1985 | Strutt et al. | 355/3 |
| 4,878,657 | 11/1989 | Ura et al. | 271/242 X |
| 5,078,384 | 1/1992 | Moore | 271/228 |
| 5,156,391 | 10/1992 | Roller | 271/227 |
| 5,246,224 | 9/1993 | Matsuno et al. | 271/242 |
| 5,253,862 | 10/1993 | Acquaviva et al. | 271/251 |
| 5,543,909 | 8/1996 | Quesnel | 271/242 X |
| 5,632,478 | 5/1997 | Quesnel et al. | 271/242 |

FOREIGN PATENT DOCUMENTS

| | | | |
|---|---|---|---|
| 57-175643 | 10/1982 | Japan . | |
| 2123056 | 5/1990 | Japan | 271/242 |

OTHER PUBLICATIONS

Xerox Disclosure Journal, vol. 10, No. 1 Jan./Feb., 1985, p. 17 Author: Schoppe, et al.

*Primary Examiner*—David H. Bollinger
*Attorney, Agent, or Firm*—Kevin R. Kepner

[57] ABSTRACT

A sheet aligning and registration device for a printing machine. In a stalled roll registration device there is provided a drive mechanism preceding the stalled roll and a sensor to determine the size of a buckle formed in a sheet as it is fed into the registration nip formed by the stalled roll pair. When the buckle reaches a predetermined size the sensor generates a signal which causes the drive controller to briefly pulse the registration roll pair. This brief pulse of the registration roll pair captures the sheet in the nip in a deskewed and registered position for subsequent feeding in a timed relationship to a machine subsystem. A baffle located between the drive nip and registration nip directs the sheet buckle formation in a controlled manner so that proper deskewing and registration forces are obtained.

6 Claims, 5 Drawing Sheets

TWO STEP OPTIMIZED STALLED ROLL REGISTRATION AND DESKEW

This invention relates generally to a sheet registration device, and more particularly concerns a stalled nip registration feeder.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, it is necessary to align and register the individual cut sheets so that the developed image is placed in the proper location on the sheet. Various schemes have been developed to assure that the image receiving sheet is in the proper location and forwarded at the proper time. Some complex printing machines utilize various sensors and translating nips to align the sheet in the proper position for receiving the image. Other machines utilize variable speed stepping motors to differentially drive a sheet within a sheet path for deskew and registration purposes. Both of these registration methods require sophisticated control and are relatively high cost.

Another method for registering and aligning a sheet is the use of stalled rolls. In the stalled roll technique, a sheet is driven into a nip in which the rolls are stopped causing a buckle to be formed between the stalled roll and the driving rolls. The force of the buckle causes the lead edge of the sheet to align itself within the stalled nip and the stalled nip is then activated so that the sheet is forwarded in the proper aligned position. Other systems utilize a stalled roll with a solenoid actuated drive nip in which the drive nip preceding the stalled roll so that the sheet is free to deskew in the stalled nip. While simpler than the active registration systems described previously, the stalled roll technique with solenoid actuated nip still requires a solenoid to deactivate the drive nip. Other problems arise if the buckle in a stalled roll system gets too large which can then cause the registration force to decrease and the lead edge of the sheet to back out ogf the nip causing skew.

It is desirable to have a stalled roll registration device in which a sheet could be deskewed and registered within the stalled nip and then secured prior to being forwarded in timed registration to a subsequent machine subsystem.

The following disclosures may relate to various aspects of the present invention.

U.S. Pat. No. 5,253,862 Patentee: Acquaviva, et al Issue Date: Oct. 19, 1993

U.S. Pat. No. 5,156,391 Patentee: Roller Issue Date: Oct. 20, 1992

U.S. Pat. No. 5,078,384 Patentee: Moore Issue Date: Jan. 7, 1992

U.S. Pat. No. 4,523,832 Patentee: Strutt, et al Issue Date: Jun. 18, 1985

JP-57-175643 Patentee: Eisaku Saiki Issue Date: Oct. 28, 1982

Xerox Disclosure Journal Vol. 10, No. 1 January/February, 1985, Pg. 17 Inventor: Schoppe, et al U.S. application Ser. No. 08/415,797 Inventor: Quesnel et al. Filing Date: Apr. 3, 1995

Some portions of the foregoing disclosures may be briefly summarized as follows:

U.S. Pat. No. 5,253,862 discloses a sheet handler including an idler and driven cross roller set. The rollers are preloaded so that a normal force exists between the rollers at the nip. The nip is provided with an apparatus for adjusting the preloaded force to adjust the normal force on the sheet material passing through the nip.

U.S. Pat. No. 5,156,391 describes an apparatus and method to deskew sheets in the short paper path by differentially driving two sets of rolls so as to create a paper buckle buffer zone in the sheet and then differentially driving a roll set to correct skew while the sheet is still within the nips of multiple drive roll sets.

U.S. Pat. No. 5,078,384 discloses a method and apparatus for deskewing and registering a sheet, including the use of two or more selectably controllable drive rolls operating in conjunction with sheet skew and lead edge sensors for frictionally driving and deskewing sheets having variable lengths. Sheets will be advanced to reach a predetermined registration position at a predetermined velocity and time at which time the sheets will no longer be frictionally engaged by the drive rolls.

U.S. Pat. No. 4,523,832 describes a sheet transport, including an outer curve guide surface input, either intermediate and output drive rolls, spaced apart less than the length of the drive sheet. The disengageable output drive nip cooperates with an opposed guide surface and one or more retractable stops to achieve registration of the copy sheet with the image.

JP-57-175643 describes a stalled roll technique of deskewing whereby the leading edge of a sheet is fed into the bite point of a set of stationary rollers causing the sheet to be deformed into a line by means of force supplied by a paper buckle along the stationary rolls, at which time the rolls are activated and the sheet is driven to the next station or set of rolls.

Xerox Disclosure Journal, Vol. 10, No. 1, Pg. 17, describes a single revolution electromagnetic friction clutch having feed rollers which are segmented rather than traditional full circumference feed rolls or wheels. The segmented feed rolls are utilized to forward a sheet until a predetermined sensor is actuated at which time the roll is engaged and the segmented portion disengages from the sheet, allowing the sheet to be forwarded by a secondary drive nip.

U.S. application Ser. No. 08/415,797 describes a stalled roll registration device in which there is provided a drive mechanism preceding the stalled roll which allows a sheet to move while within the drive nip. The drive mechanism uses a drive roll and an eccentric idler roll in contact therewith. The idler is biased against the drive roll by a compression spring such that as the eccentric idler roll rotates, the spring is alternately compressed and relaxed. When a sheet is driven through the drive mechanism and into the stalled nip, a buckle is formed which causes a force to be exerted on the drive nip which causes the eccentric roll to stall in the horizontal position in which little normal force is exerted on the sheet. The sheet is then free to deskew and align in the stalled nip.

In accordance with one aspect of the present invention, there is provided an apparatus for registering a sheet in a path. The apparatus comprises a registration nip located in the path, a drive nip for transporting a sheet, preceding the registration nip; a sensor located between the drive nip and the registration nip to sense a buckle in the sheet and generate a signal indicative thereof; and a controller which receives the buckle signal from the sensor and generates a brief drive pulse signal so as to advance the sheet a small distance and capture the sheet in the registration nip.

Pursuant to another aspect of the present invention, there is provided a printing machine in which a sheet is driven along a path and fed in a timed relationship and registration position to a process station. The printing machine comprises a registration nip located in the path, a drive nip for transporting a sheet, preceding the registration nip; a sensor located between the drive nip and the registration nip to sense a buckle in the sheet and generate a signal indicative thereof; and a controller which receives the buckle signal from the sensor and generates a brief drive pulse signal so as to advance the sheet a small distance and capture the sheet in the registration nip.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
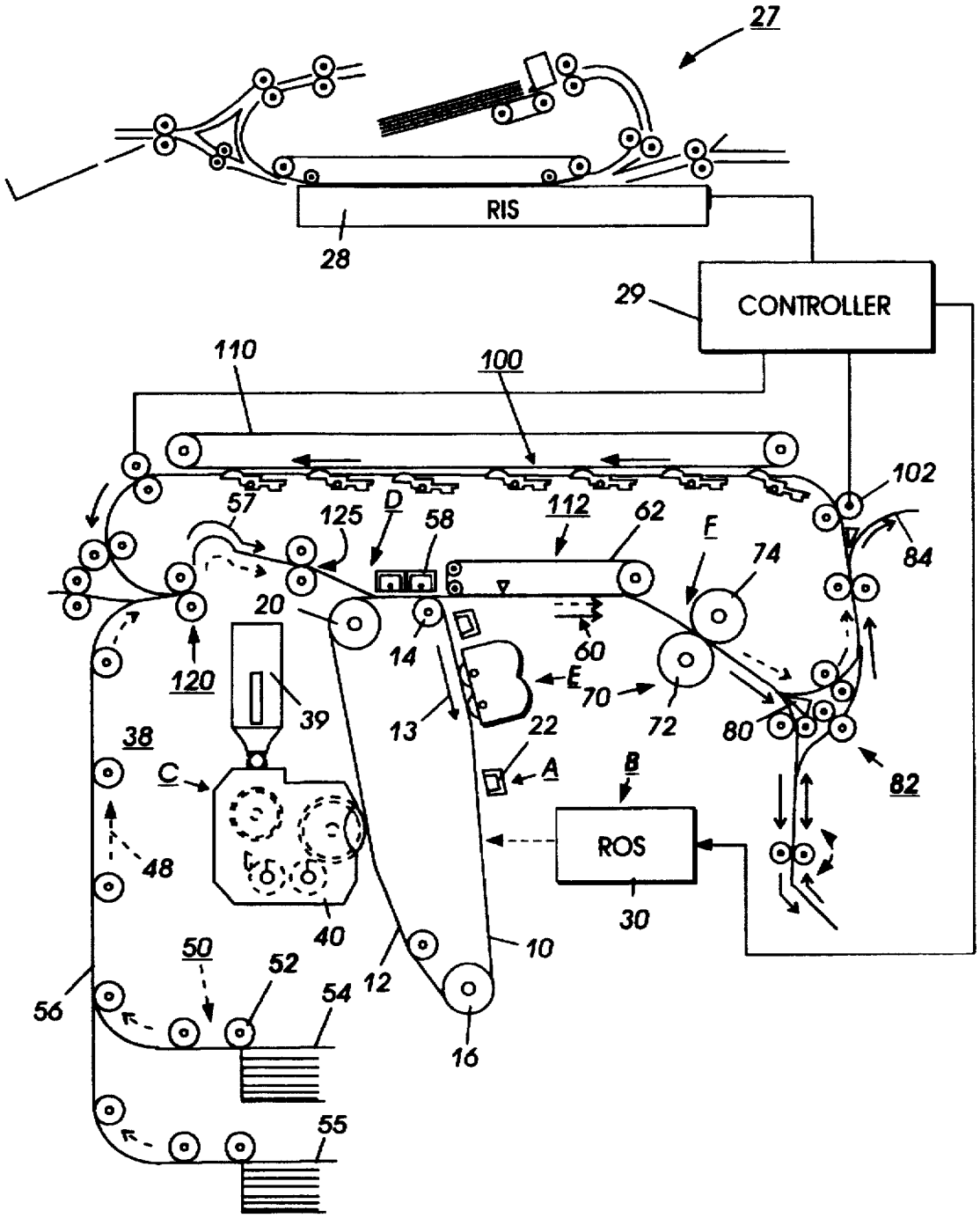
FIG. 1 is a schematic elevational view of a typical electrophotographic printing machine utilizing the sheet deskew and registration device of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the stalled roll registration device of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 125 past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
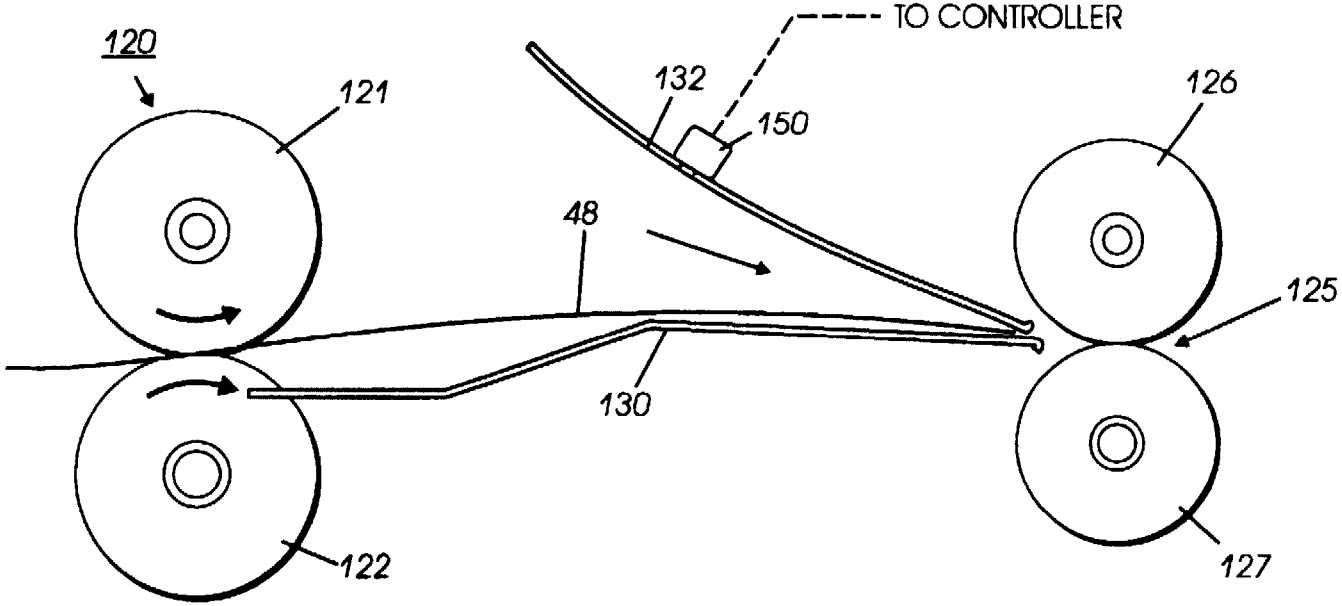
FIG. 2 is a detailed front side view of the stalled roll registration device of the present invention.

Turning next to FIG. 2, a detailed illustration of the stalled roll registration device of the present invention is illustrated. The stalled roll registration system works in the following manner. The lead edge of a constantly moving sheet 48 comes up against a non-moving or stalled registration nip 125 formed by drive roll 127 and idler roll 126. The sheet is deskewed as the body of the sheet 48 pivots about in a buckle chamber formed between baffles 130 and 132. The shape of the chamber, the nip frictions and loads, the sheet momentum, and sheet tip tangent forces all affect the deskew performance. High nip tangent forces drive the sheet 48 into the nip 125. Full movement of the lead edge in the nip 125 is a prerequisite for an effective deskew. After approximately 5 to 10 mm of sheet buckle, the tip tangent force drops due to changes in the buckle shape of the sheet. (The tip tangent force is the forward pushing force of the sheet into the registration nip.) In the extreme case, a very large buckle causes sheet rollover and the lead edge backs out of the registration nip. Preferably, the sheet lead edge should be pushed firmly against the registration nip at all times.

Figure 3:
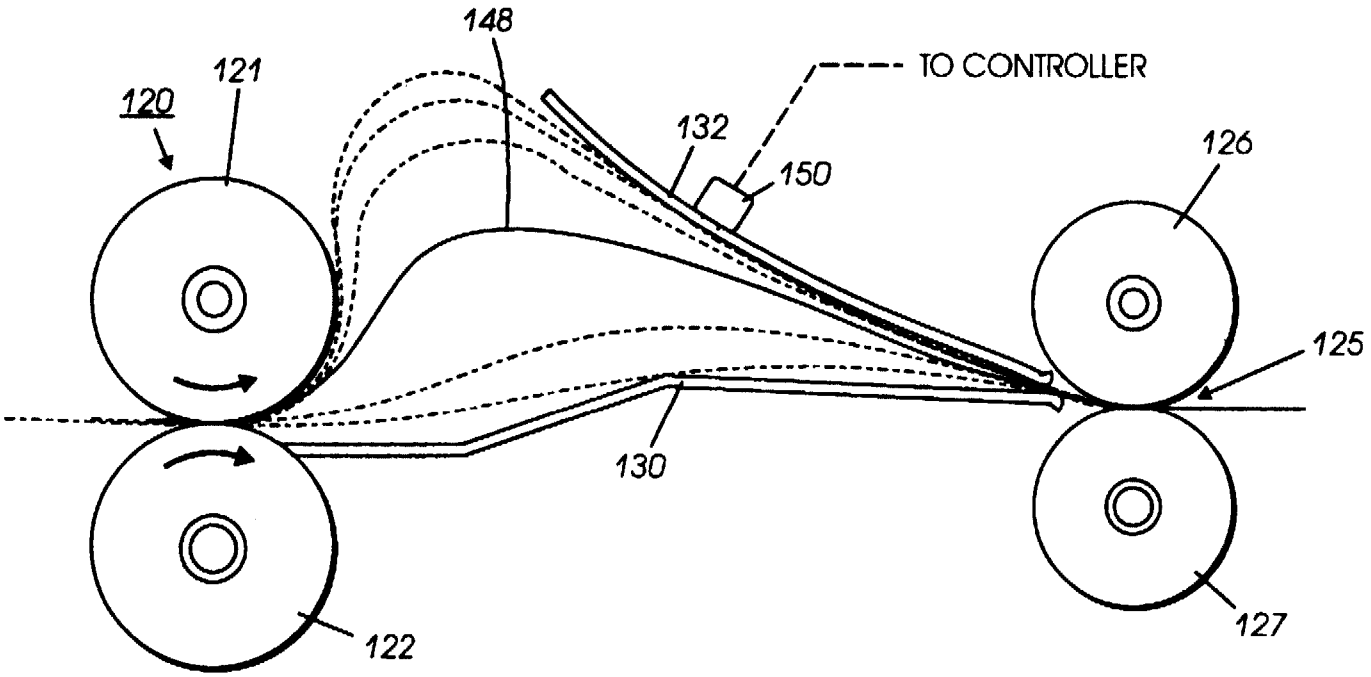
FIG. 3 is a side view of the various profiles of a sheet as it is registered in the FIG. 2 device.
Figure 4:
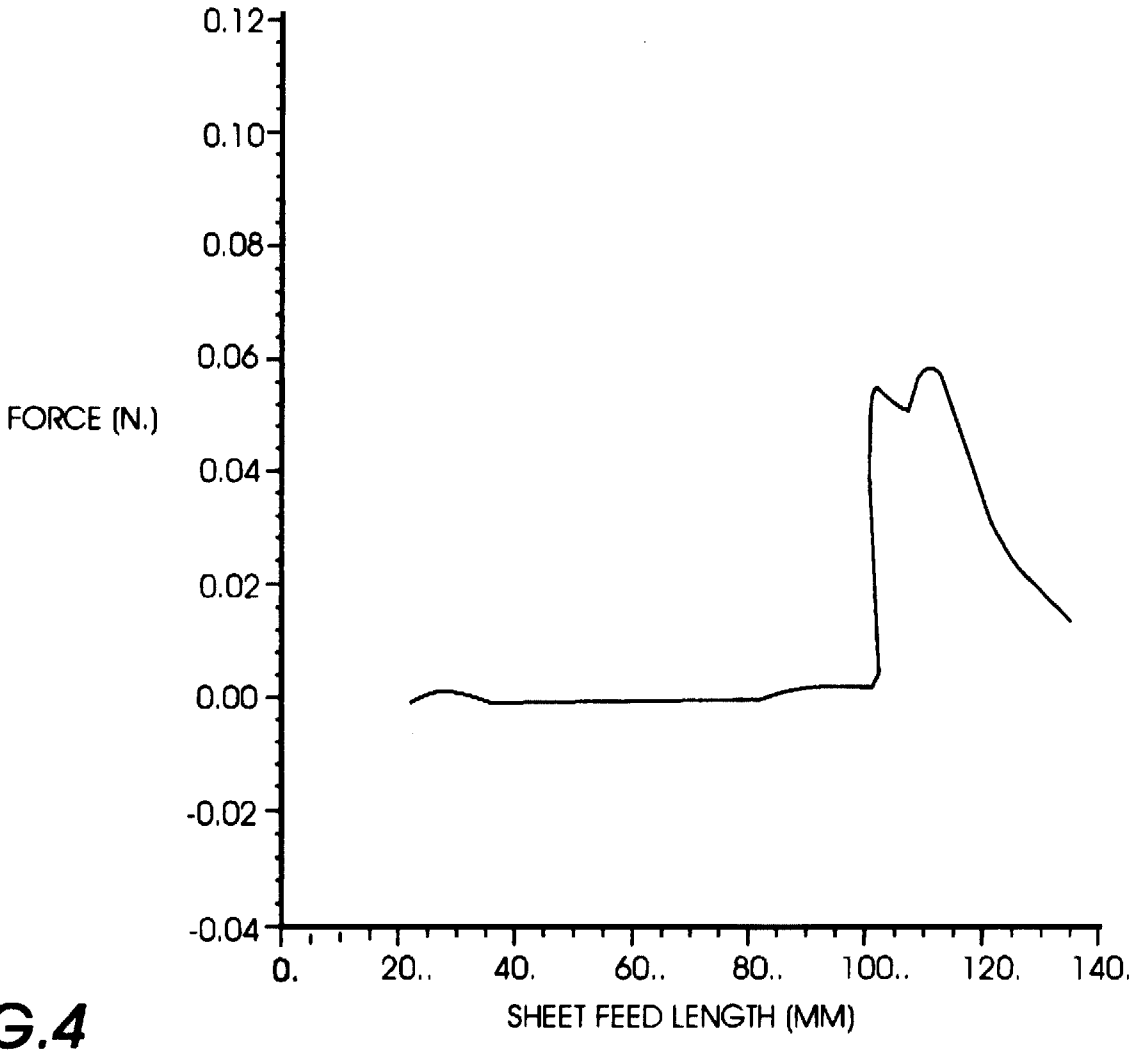
FIG. 4 is a graphical representation of the nip tangent force as a function of feed distance in a stalled roll registration device which does not use the invention herein.

FIG. 3 illustrates the profiles of a sheet as it is driven into the registration nip and forms a buckle within the buckle chamber. The profile reference number 148 represents a 10 mm buckle and as shown in the graph illustrated in FIG. 4 is when the maximum sheet tip tangential force is achieved. (At 100 mm, the buckle length is zero due to the spacing of the nips).

As illustrated in FIG. 4, it can be seen that as the buckle increases beyond 10 mm the tip tangential force decreases dramatically, thereby reducing the ability of the sheet to register in the stalled nip.

To keep the tip tangent force as high as possible, the device herein optimizes deskew by indexing the registration drive roll 127 after 5 to 10 mm of buckle. A sensor 150 located in the buckle chamber indicates when 5 to 10 mm of sheet buckle has occurred. At that point, the deskewed sheet 48 advances a fixed distance forward and is captured in the registration nip at that point. At a further point in time, the registration clutch can then be activated again to send the sheet in time relation to the photoreceptor for transfer.

Figure 5:
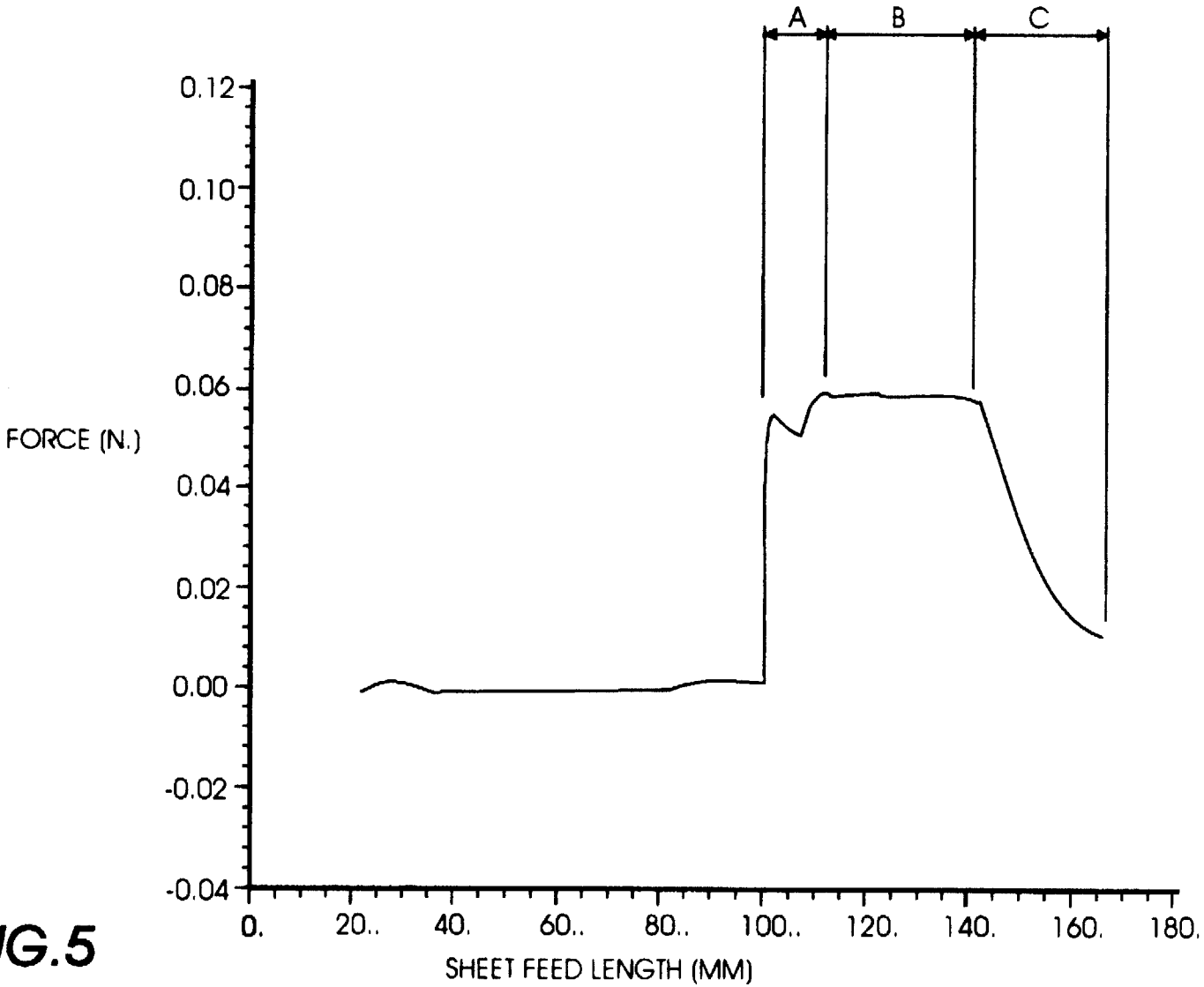
FIG. 5 is is a graphical representation of the nip tangent force as a function of feed distance in a stalled roll registration device which utilizes the invention herein.

FIG. 5 illustrates graphically the optimized sheet deskewing performance of the device of the present invention. It can be seen that the tip tangential force increases dramatically at sheet feed lengths from 100 to 110 mm. AS the 10 mm buckle is formed, represented by graphic section A, the maximum tip tangential force is achieved. At that point, the registration nip is indexed forward a fixed amount (i.e. one-half of a revolution) and the sheet is captured in the registration nip. the force is graphically a horizontal line at this point due to the fact that the sheet is now contained by the frictional forces and the normal force of the registration nip 125 which is transporting the sheet lead edge the same distance as the drive nip 120 which thus maintains a fixed buckle shape and therefore the tangential force does not drop off.

While the invention herein has been described in the context of an image transfer sheet registration device, it will be readily apparent that the device can be utilized in any sheet feeding situation which requires individual sheets to be delivered in a timed relationship.

In recapitulation, there is provided a sheet aligning and registration device for a printing machine. In a stalled roll registration device there is provided a drive mechanism preceding the stalled roll and a sensor to determine the size of a buckle formed in a sheet as it is fed into the registration nip formed by the stalled roll pair. When the buckle reaches a predetermined size the sensor generates a signal which causes the drive controller to briefly pulse the registration roll pair. This brief pulse of the registration roll pair captures the sheet in the nip in a deskewed and registered position for subsequent feeding in a timed relationship to a machine subsystem.

It is, therefore, apparent that there has been provided in accordance with the present invention, a sheet registration and aligning device and method that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for registering a sheet in a path, comprising:

a registration nip located in the path;

a drive nip for transporting a sheet, preceding said registration nip;

a sensor located between said drive nip and said registration nip to sense a buckle in the sheet and generate a signal indicative thereof;

a controller which receives the buckle signal from said sensor and generates a brief drive pulse signal to said registration nip so as to advance the sheet a small distance and capture the sheet in said registration nip.

2. An apparatus according to claim 1, wherein said registration nip comprises:

a drive member;

an idler member, in contact with said drive member to form a nip therebetween.

3. An apparatus according to claim 1, further comprising a baffle located between said drive nip and said registration nip, said baffle being configured so as to direct the sheet buckle formation in a controlled manner.

4. A printing machine in which a sheet is driven along a path and fed in a timed relationship and registration position to a process station, comprising:

a registration nip located in the path;

a drive nip for transporting a sheet, preceding said registration nip;

a sensor located between said drive nip and said registration nip to sense a buckle in the sheet and generate a signal indicative thereof;

a controller which receives the buckle signal from said sensor and generates a brief drive pulse signal to said registration nip so as to advance the sheet a small distance and capture the sheet in said registration nip.

5. A printing machine according to claim 4, wherein said registration nip comprises;

a drive member;

an idler member, in contact with said drive member to form a nip therebetween.

6. A printing machine according to claim 4, further comprising a baffle located between said drive nip and said registration nip, said baffle being configured so as to to direct the sheet buckle formation in a controlled manner.

* * * * *